US005144123A

United States Patent [19]

Malashanko

[11] Patent Number: 5,144,123

[45] Date of Patent: Sep. 1, 1992

[54] X-RAY IMAGE DISSECTING INTENSIFIER WITH PINHOLE APERTURE ANODE FOR IMAGE DISSECTION

[76] Inventor: Karl Malashanko, P.O. Box 362, Little Lake, Mich. 49833

[21] Appl. No.: 710,979

[22] Filed: Jun. 6, 1991

[51] Int. Cl.[5] ..... H01J 31/50

[52] U.S. Cl. ..... 250/213 VT; 313/532

[58] Field of Search ..... 250/213 VT; 313/382, 313/532, 533, 383

[56] References Cited

U.S. PATENT DOCUMENTS 3,719,823 3/1973 Sheldon ..... 250/213 VT 4,243,878 1/1981 Kalibjian ..... 250/213 VT

*Primary Examiner*—David C. Nelms

*Assistant Examiner*—T. Davenport

*Attorney, Agent, or Firm*—Weintraub, DuRoss & Brady

[57] ABSTRACT

An image dissecting intensifier tube for use in an x-ray examination system is taught. X-ray photons pass through a subject are received by the image dissecting intensifier tube, which converts the photons to electrons. By use of electrostatic plates, the electrons are accelerated, deflected horizontally and vertically, and focused as they pass through the tube. The electrons emit from the tube by feeding the electron image line-by-line through a small aperture formed in the anode of the tube. The video signal that pass through the aperture are received by a multiplier tube built onto the image dissecting intensifier tube which amplifies the signal. The signal passes to a video control unit, which takes the amplified signal and mixes the signal with horizontal and vertical sweep signals, producing a composite video signal. The composite video signal is then displayed on a monitor for viewing. The image obtained is brighter and clearer than that achieved by traditional x-ray systems.

9 Claims, 3 Drawing Sheets

FIG 1
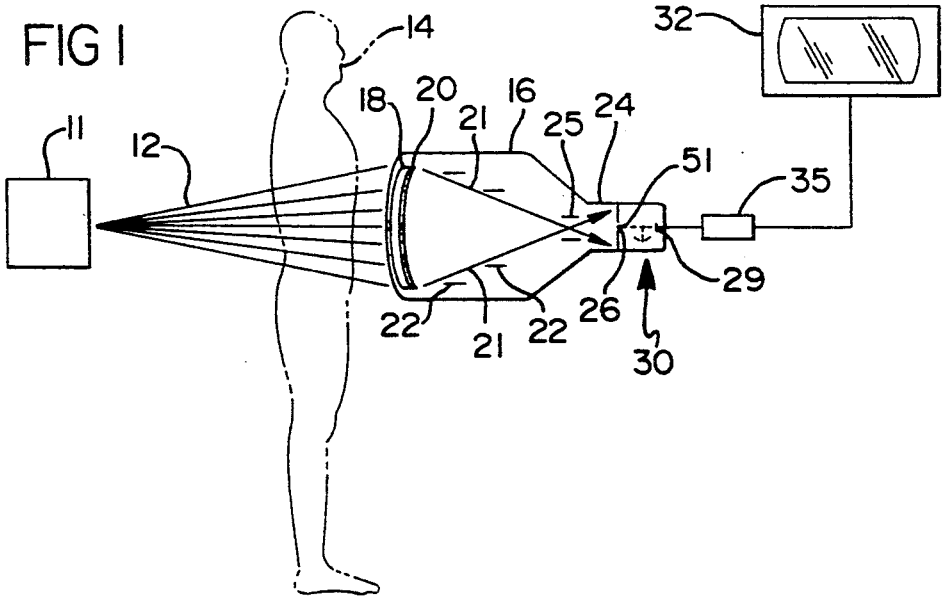
FIG 2
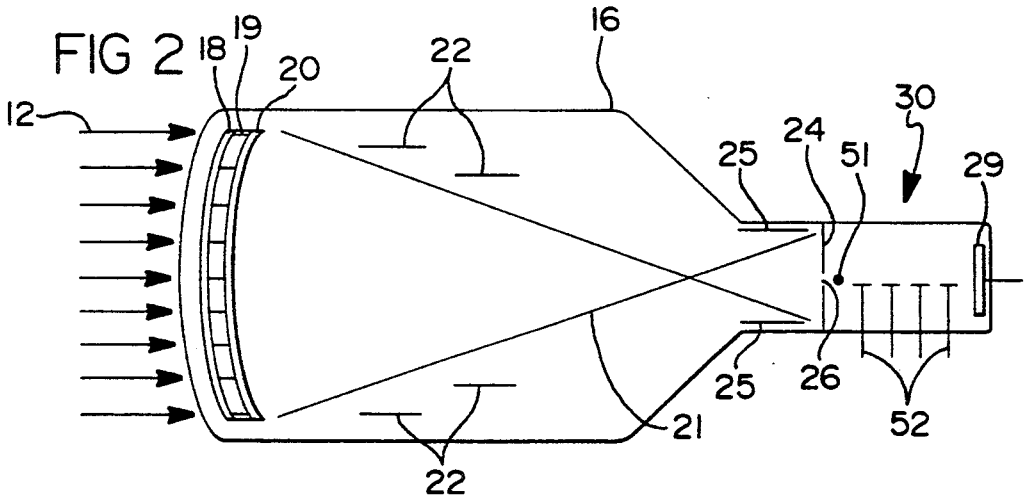
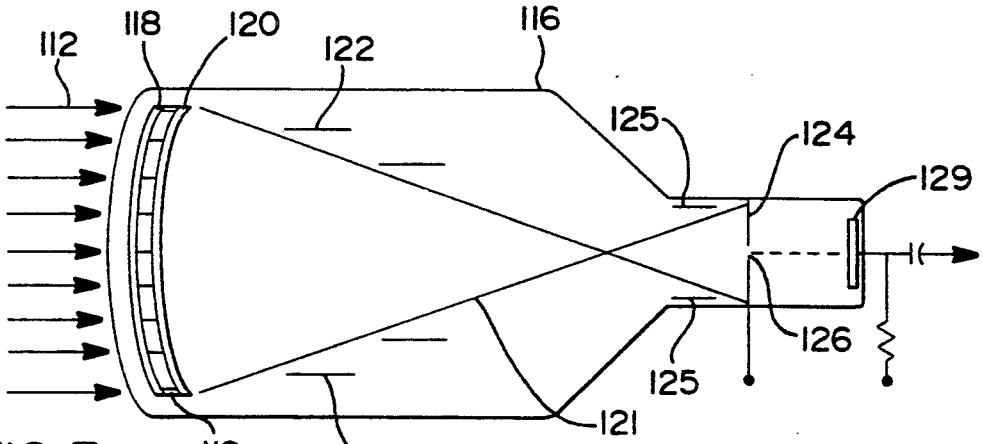
FIG 3

FIG 4
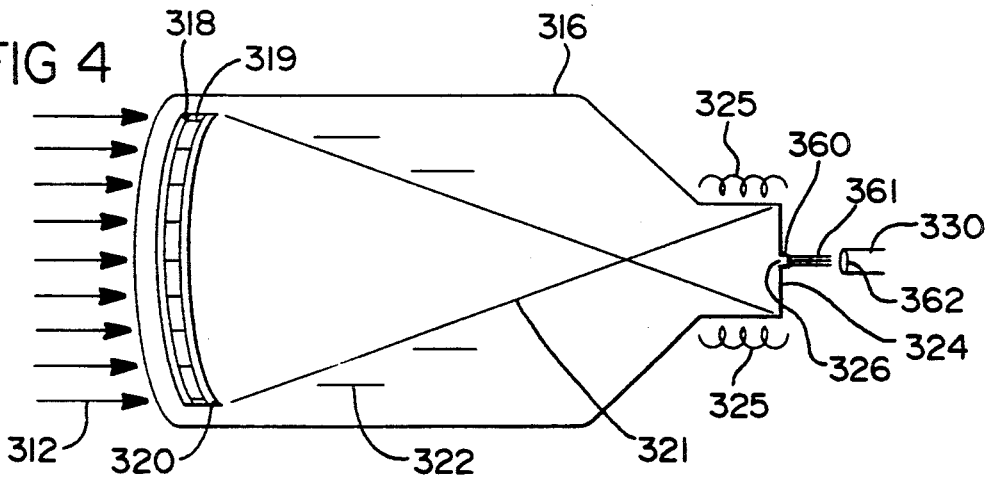
FIG 5
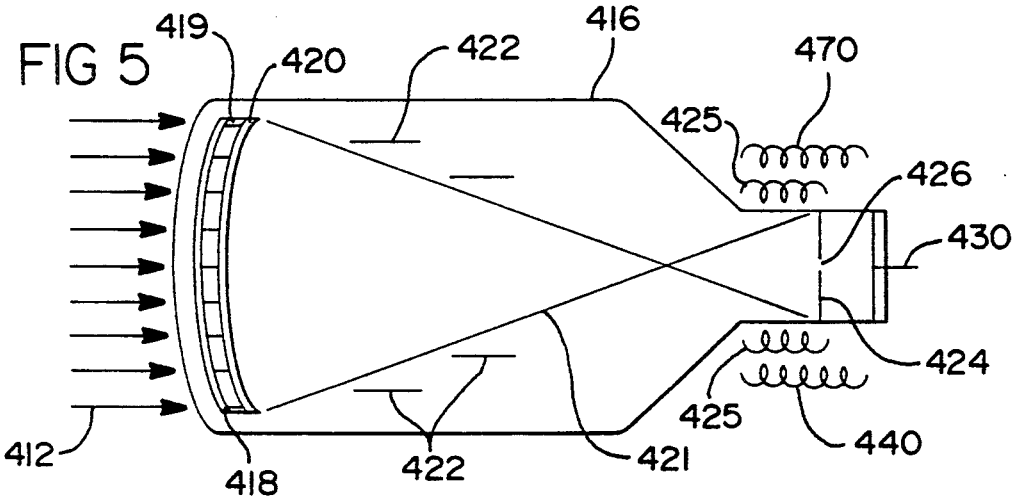
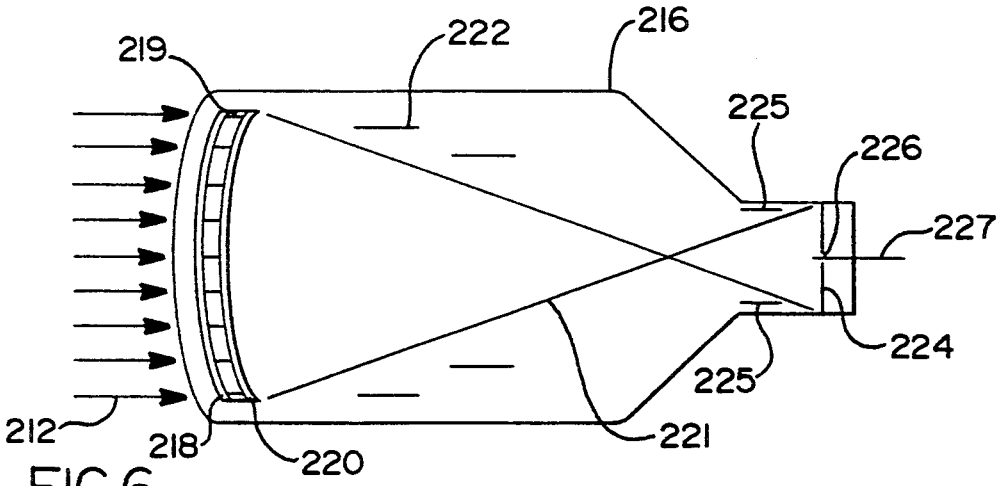
FIG 6

X-RAY IMAGE DISSECTING INTENSIFIER WITH PINHOLE APERTURE ANODE FOR IMAGE DISSECTION

FIELD OF THE INVENTION

The present invention concerns an x-ray fluoroscopic system for viewing x-ray images on a video monitor, with the capability of transferring the image to x-ray film. More particularly, the present invention concerns an x-ray system having means for obtaining a sharper and clearer image. Even more particularly, the present invention concerns an image dissector in the video chain of an x-ray system, thereby obtaining a sharper and clearer image.

DESCRIPTION OF THE PRIOR ART

The utility of x-ray photographs as a diagnostic tool emerged after the discovery of the fluorescence phenomenon. This phenomenon concerns the property of certain inorganic salts to emit light photons almost instantaneously when exposed to radiation. This allows the visual observance of dynamic processes.

The original fluoroscopic system operated by receiving the emitted light photons from the photographic subject on a fluoroscopic screen, where the image was displayed. This system, however, is severely limited due to the poor light transfer efficiency of the screens. This situation is overcome by the development of the image intensifier. The output of the image intensifier is received by a television camera, which displayed the image on a video monitor.

The video chain includes three parts of the x-ray system: an image intensifier, a video camera and a visual monitor. After x-ray photons pass through a photographic object, the image intensifier converts the x-ray photons to electrons. These electrons are then accelerated, focused and converted back into light photons by striking an output phosphor. This substantially lessens the dimness problems one encounters with the fluoroscopic screens. The image intensifier, however, produces an image too small to be viewed by more than one person. This difficulty is overcome by the television or video monitor. The video camera receives the light photons from the image intensifier, scanning and enlarging them. From here, the image is converted into electrons and sent to the visual monitor to allow viewing by a number of persons. While an improvement over the fluoroscopic screens, the video chain experiences diminished spatial resolution of the image.

An image intensifier tube typically includes an input phosphor at the cathode end of the tube. The input phosphor converts the invisible x-ray photons to visible light photons. These visible light photons strike a photocathode, which converts the photons to electrons. The electrons move toward the anode of the tube. As they travel, electrostatic plates narrow the path of the electrons. This focuses the image comprised of the electrons and accelerates the electrons. The electrons then strike an output phosphor, converting the kinetic energy of the electrons to light photons that emit from the tube.

Recently, the art has, in varying ways, seen attempts to improve the brightness of images. For example, U.S. Pat. No. 4,912,737, issued Mar. 27, 1990, to Oshuka et al., teaches the addition of a magnifying device allowing microscopic viewing of a selected area. U.S. Pat. No. 4,943,988, issued Jul. 24, 1990, to Gerlach et al., teaches an x-ray device with fiber optic transmitters between the video camera and monitor. The fiber optics allow a highlighting of a selected portion of the fluoroscopic image. U.S. Pat. No. 4,907,252, issued Mar. 6, 1990, to Aichinger et al., teaches the use of a computer to store previous x-ray photographs in memory. These photos help to precisely position the patient for later re-examination of the same area. U.S. Pat. No. 4,937,848, issued Jun. 26, 1990, to Horbaschek et al., teaches the use of a computer in the video chain, allowing the processing of the signal and repositioning of the image in the monitor.

These prior art devices, however, only attempt to minimize the losses incurred in the video chain, or to supplement the video chain. No art is known, however, that eliminates the losses by simplifying the video chain.

SUMMARY OF THE INVENTION

The present invention is an x-ray examination device, comprising:

(a) means for generating an x-ray image, the x-ray image comprising x-ray photons, of a subject;

(b) an image dissecting intensifier tube, the tube comprising:

(1) an outer casing;

(2) an input phosphor disposed within the casing, the input phosphor receiving the x-ray photons from the means for generating and converting the x-ray photons to visible light photons;

(3) a photocathode disposed in the casing adjacent the phosphor, the photocathode receiving the visible light photons and converting them to electrons;

(4) a plurality of axially aligned electrostatic lenses, the lenses accelerating and focusing the electrons, the electrons passing through the lenses from one to another serially;

(5) a first anode adjacent the lenses, the anode drawing the electrons through the tube, the anode having a pinhole aperture formed therein, the anode allowing other electrons to pass through the aperture in a dissected manner;

(6) a plurality of horizontal and vertical deflection plates disposed within the casing adjacent the anode; and (7) a multiplier tube, the multiplier tube attached to the anode and having a second cathode, a plurality of dynodes and a second anode, the multiplier tube receiving and amplifying dissected electrons;

(c) a video control unit, the unit receiving the amplified electron signal, and adding horizontal and vertical sweep signals to the video signal, the sweep signals mixing with the video signal to provide a mixed signal capable of display on a video monitor; and (d) a video monitor to display the mixed signal.

The present invention may additionally comprise horizontal and vertical deflection coils disposed around the anode of the image dissecting intensifier tube. These coils serve to deflect the electrons horizontally and vertically.

The present invention may further comprise focus coils disposed about the anode of the image dissecting intensifier tube to sharpen the image represented therein. Also, an output phosphor may be disposed at the aperture of the image dissecting intensifier tube to convert the electrons therein to visible light photons. A light detection device, such as a phototube or photocell, would detect the visible light photons and convert them to electrons for mixing with the deflection signals. This would offer an alternative means of detecting the electrons.

Other attendant advantages will be more readily appreciated as the same becomes better understood by reference to the following detailed description and considered in connection with the accompanying drawings in which like reference numerals designate like parts throughout the figures, in which:

BRIEF DESCRIPTION OF THE DRAWINGS

FIG. 1 is a schematic diagram of the x-ray image device, in use, utilizing the present invention;

FIG. 2 is a perspective view of the image dissecting intensifier tube employed in the practice of the present invention;

FIG. 3 is a perspective view of second embodiment of the image dissecting intensifier tube;

FIG. 4 is a perspective view of a third embodiment of the image dissecting intensifier tube, with an output phosphor and light detecting device disposed thereon;

FIG. 5 is a perspective view of a fourth embodiment of the image dissecting intensifier tube with focus coils and horizontal and vertical deflection coils disposed therearound; and FIG. 6 is a perspective view of a fifth embodiment of the image dissecting intensifier tube with a needle electrode through the aperture.

DETAILED DESCRIPTION OF THE PREFERRED EMBODIMENT

Figure 7:
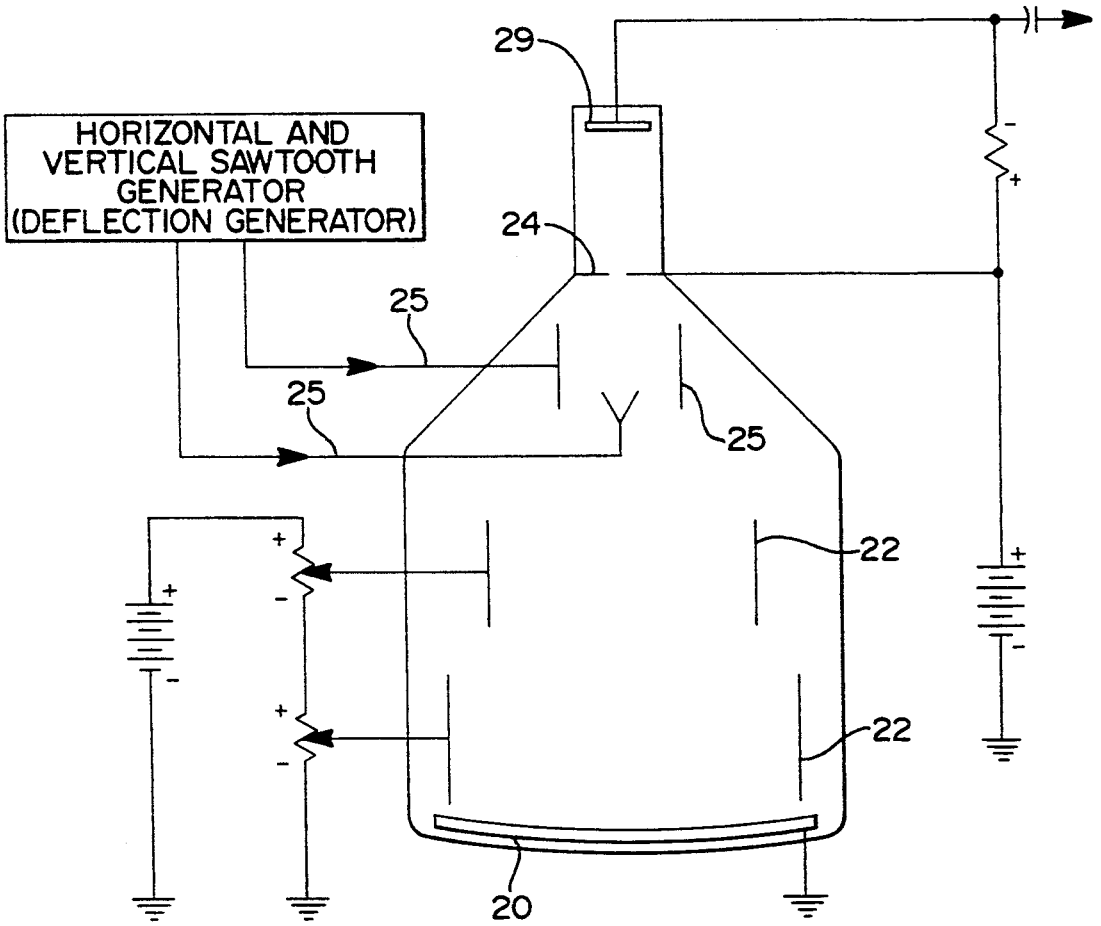
FIG. 7 is a schematic diagram of the x-ray image device with the horizontal and vertical deflection Generator disposed therein.

Referring now to FIGS. 1, 2 and 7, there is depicted an x-ray examination device of the present invention. The device hereof includes means for generating 11 an x-ray image, such as an x-ray generator. The x-ray generator 11 includes an x-ray tube, transformers, rectifiers, power supplies, exposure timer mechanisms, and overload protection devices, all of which are known to one having ordinary skill in the art. The generator 11 produces and directs x-ray photons 12. The x-ray photons 12 travel toward a target, here shown as an image dissecting intensifier tube 16. Between the x-ray generator 11 and the tube 16 is an x-ray subject 14, shown in FIG. 1 as a human being. The subject 14 could be an animal, a package or other object.

As noted, after passing through the subject 14, the x-ray photons 12 enter the tube 16 and strike an input phosphor 18. The input phosphor 18 converts the x-ray photons 12 into visible light photons. The visible light photons leave the input phosphor 18 and strike a photocathode 20. The photocathode 20 converts the light photons to electrons 21.

The electrons 21 move then toward a first anode 24. As the electrons 21 travel through the tube 16 toward the anode 24, the path of the electrons 21 narrows due to a plurality of electrodes or electrostatic lenses 22. The electrodes 22 control the movement of the electrons 21 by electric fields emitted therefrom. Successive electrodes 22 focus and accelerate the electrons 21. The electrodes 22 are cylindrical members, each member having a successively smaller diameter, as shown. Thus, the electrodes funnel or channel the electrons. It is by this funneling that the electrons accelerate and focus. The deflection plates 25 deflect horizontally and vertically the electrons 21. The electrons 21 then gather at the first anode or anode 24, where most of the electrons 21 are absorbed. The remaining electrons 21 pass, line-by-line, through an aperture 26 formed in the anode 24, thereby dissecting the electrons in the well-known manner.

The dissected electrons are then attracted to a cathode 51 at a multiplier tube 30.

The multiplier tube 30 dynodes provide additional amplification of the dissected electrons. The electrons 21 then leave the multiplier tube 30 through the anode 29, and are mixed with horizontal and vertical sweep signals in a video control unit 35. The video control unit 35 produces a composite video signal, which can be displayed and thereby viewed on a television monitor 32.

FIG. 7 shows an electrical schematic design of the preferred embodiment. The circuiting and grounding of the electrodes, anode and plates are shown.

The present invention offers two significant benefits over the video chain as it is currently practiced. The first is the elimination of inefficiency.

The traditional video chain must convert the electrons in the image intensifier to light photons, so the video camera may convert the photons to an electron signal for viewing. This process encounters reductions in image brightness for each conversion, as well as for the lenses and apparatus of the camera. Also, the traditional intensifier emits light, since it is not in a vacuum. Thus, the traditional intensifier is subject to the effects of environmental noise which further degrades the signal.

The present invention realizes critical gains in image quality by eliminating all of these factors. The electrons feed directly from tube to tube, or tube to output. Therefore, no environmental noise is encountered. The signal-to-noise ratio is enhanced by eliminating signal losses suffered in the conversion process. The elimination of the light photons obviates the necessity of the camera, avoiding the inefficiencies inherent therein.

The second significant benefit is the improved ability to manipulate the image. The traditional video chain must treat the image as a whole, or implement devices such as fiber optics or computers to access smaller pieces. The present invention, by producing a dissected image, allows easy manipulation of pieces of the image, or the entire image. The viewer can choose an infinite selection of views. Further, storage and other treatment of the image can be easily affected.

The achievement of a higher resolution allows for the usage of smaller dosages of radiation. There are two ways of achieving greater brightness and clarity in x-ray images: higher doses of radiation or greater transfer efficiency of the x-ray system. The first alternative is unacceptable for safety and health reasons. The present invention, however, achieves the second. Its success in doing so allows for the application of lower dosages of radiation while still obtaining an image of superior quality.

Another advantage of the present invention is the ability of the viewer to choose an infinite selection of the field size. Since the image in electron form is being fed line-by-line through the dissector, any field dimension of the image can be selected for viewing, amplifying, etc. Since the image is already dissected, supplementary devices, such as fiber optics and computers are unnecessary. Thus, the present invention offers a simpler and more efficient design. The present invention, however, can be placed in communication with a computer or other storage or manipulation device to effect desired applications with the image data.

Referring to FIG. 7, a schematic of the operation of the preferred embodiment is shown.

Referring now to FIG. 3, a second embodiment of the image dissecting intensifier tube 116 is shown. The flow of the x-ray photons 112 into the tube 116, the conversions effected by the input phosphor 118 and the photocathode 120 are identical to the preferred embodiment. In this embodiment, the horizontal and vertical deflection plates 125 are located forwardly of the anode 124, the electrostatic fields of the plates 125 deflecting the electrons 121 horizontally and vertically. From here, the electron image 121 passes to and through the aperture 126, dissecting the electron image 121. The electrons 121 then travel to the second anode 129 and leave the image dissecting intensifier tube 116. Except for the elimination of the phototube, all other aspects, the second embodiment is similar to the first.

Referring now to FIG. 4, a third embodiment of the present invention has an output phosphor dot 360 at the aperture 326 of the anode plate 324. This allows light photons 361 to pass to a light detection device 362, such as a photo-transistor, for further processing. Although less efficient than the preferred embodiment, this alternative allows a more efficient transfer, by virtue of the dissection, than is currently achievable by the traditional video chain. The replacement of deflection plates with deflection coils 325 is another way of achieving deflection. In all other aspects, this fourth embodiment is similar to the preferred embodiment.

Referring now to FIG. 5, a fourth embodiment of the present invention has focus coils 470 disposed around the anode 424. Also, horizontal and vertical deflection coils 425 are disposed therearound. These deflection coils 425 and the focus coils 470 offer a different means to sharpen the image as it is being dissected. This embodiment eliminates the deflection plates 25 of the preferred embodiment. In all other aspects, this embodiment is similar to the preferred embodiment.

Referring now to FIG. 6, a fifth embodiment of the present invention is shown therein having a needle electrode 227 disposed through the aperture 226 formed in the anode 224. The needle electrode 226 acts as an additional anode, picking up electrons 221 as they are swept past the electrode 227 by deflection plates 225. In all other aspects, this embodiment is similar to the preferred embodiment.

Having, thus, described the invention, what is claimed is:

1. An x-ray image observing device comprising:

(a) means for generating an x-ray image the x-ray image comprising of x-ray photons of a subject;

(b) an image dissecting intensifier tube, the tube comprising:

(1) an outer casing;

(2) an input phosphor disposed within the casing, the input phosphor receiving the x-ray photons from the means for generating and converting the x-ray photons to visible light photons;

(3) a photocathode disposed in the casing adjacent to the phosphor, the photocathode receiving the visible light photons and converting them to electrons;

(4) a plurality of axially aligned electrostatic lenses, the lenses accelerating and focusing the electrons, the electrons passing through the lenses from one to another serially;

(5) an anode adjacent to the lenses, the anode drawing the electrons through the tube, the anode having a pinhole aperture formed therein, the anode allowing the electrons to pass through the aperture in a dissected manner;

(6) a plurality of horizontal and vertical deflection plates disposed within the casing adjacent to the anode; and (7) a multiplier tube, the multiplier tube attached to the anode and having a second cathode, a plurality of dynodes and a second anode, the multiplier tube receiving the electrons through said anode and amplifying the electrons;

(c) a video control unit, the unit adding horizontal and vertical sweep signals to the amplified electrons, the sweep signals mixing with the amplified electrons to provide a mixed signal capable of display on a video monitor.

2. The x-ray image observing device of claim 1, the device further comprising an output phosphor, the output phosphor disposed at the aperture of the anode of the image dissecting intensifier, the output phosphor converting the dissected electrons into visible light photons.

3. The x-ray image observing device of claim 2, the device further comprising a light detection device, the light detection device receiving the light photons from the output phosphor and converting the light photons into an electron signal.

4. The x-ray image observing device of claim 1, the device further comprising horizontal and vertical deflection plates disposed within the image dissecting intensifier tube.

5. The x-ray image observing device of claim 1, the device further comprising horizontal and vertical deflection coils, the deflection coils disposed around the anode of the image dissecting intensifier tube.

6. The x-ray image observing device of claim 1, the device further comprising focus coils, the focus coils being disposed around the anode of the image dissecting intensifier tube.

7. The x-ray image observing device of claim 1, the device further comprising a needle electrode, the needle electrode extending through the aperture of the anode.

8. The x-ray image observing device of claim 1, the device further comprising:

a video monitor to receive the signal from the mixed signal.

9. An image dissecting intensifier tube, the tube having a cathode and an anode, the tube receiving a generated x-ray image comprising x-ray photons of an image, the tube comprising:

(a) a casing, the casing containing therein:

(b) an input phosphor, the input phosphor converting the x-ray photons to light photons;

(c) a photocathode, the photocathode converting the light photons to electrons;

(d) a plurality of electrostatic plates, the plates focusing and accelerating the electrons in the tube; and (e) an anode plate having a pinhole aperture formed therein, the plate dissecting the electrons;

wherein the dissecting sharpens and intensifies the image.

* * * * *